United States Patent [19]

Turner

[11] 4,416,739

[45] Nov. 22, 1983

[54] ELECTROPLATING OF TITANIUM AND TITANIUM BASE ALLOYS

[75] Inventor: Wallace Turner, Barnoldswick, England

[73] Assignee: Rolls-Royce Limited, London, England

[21] Appl. No.: 240,127

[22] Filed: Mar. 3, 1981

[30] Foreign Application Priority Data

Apr. 16, 1980 [GB] United Kingdom ..... 8012484

[51] Int. Cl.[3] ..... C25D 5/42

[52] U.S. Cl. ..... 204/32 R; 204/29; 204/40

[58] Field of Search ..... 204/29, 32 R, 40

[56] References Cited

U.S. PATENT DOCUMENTS

| | | | |
|---|---|---|---|
| 2,798,843 | 7/1957 | Slomin et al. | 204/32 |
| 2,921,888 | 1/1960 | Halpert | 204/32 |
| 3,087,874 | 4/1963 | Greisl | 204/140.5 |
| 3,616,279 | 10/1971 | Kendall | 204/14 N |
| 3,672,964 | 6/1972 | Bellis | 204/33 |
| 3,817,844 | 6/1974 | Kendall | 204/15 |

FOREIGN PATENT DOCUMENTS

| | | | |
|---|---|---|---|
| 874516 | 8/1961 | United Kingdom | 204/32 R |

OTHER PUBLICATIONS

Frederick A. Lowenheim, *Electroplating,* McGraw-Hill Book Company, New York, 1978 pp. 79-80, 188-189.

*Primary Examiner*—Howard S. Williams
*Assistant Examiner*—William Leader
*Attorney, Agent, or Firm*—Cushman, Darby & Cushman

[57] ABSTRACT

A method of treating a titanium or titanium base alloy surface prior to the electroplating of a metal thereon in which the surface is immersed in a solution containing hydrofluoric acid, ammonium bifluoride and dimethylformamide. Reaction between the solution and the surface results in a coating being deposited on the surface which provides better adhesion between the surface and any metal subsequently electroplated thereon.

7 Claims, No Drawings

ELECTROPLATING OF TITANIUM AND TITANIUM BASE ALLOYS

This invention relates to electroplating and in particular to the electroplating of metals on to titanium and titanium alloy substrates.

BACKGROUND OF THE INVENTION

Titanium and titanium alloy substrates are notoriously difficult to electroplate effectively with other metals as a result of poor adhesion between the substrate and the electroplated metal. One method which has been employed in an attempt to overcome this problem involves abrasive blasting the substrate prior to electroplating. This has the effect of removing the oxide layer present on the substrate surface and also roughening the surface in order to improve the mechanical key between the surface and the electroplated metal.

Whilst abrasive blasting is acceptable in certain circumstances, it can give rise to undesirable metallurgical changes in the substrate. This can arise, for instance, in the manufacture of titanium or titanium alloy components for aerospace use. One particular type of component which can prove to be difficult to electroplate effectively is one which comprises a hollow titanium or titanium alloy member, such as a fan blade for a gas turbine engine, which is reinforced by a titanium honeycomb structure. The honeycomb structure is brazed to the inner wall of the hollow member so as to provide rigidity and strength for the assembly. A convenient way of ensuring that the correct amount of brazing alloy is present comprises electroplating the relevant contact areas of either the honeycomb structure or hollow member with layers of the elemental constituents of the brazing alloy. Brazing is then achieved by clamping the honeycomb structure and hollow member together and applying heat to melt the brazing alloy elemental constituents.

Since abrasive blasting is metallurgically undesirable in components of this type, it has been suggested that the regions of the components which are to be brazed could be etched with a suitable acid etching solution. However, when etching is completed, it has been found that the oxide layer quickly re-forms on the etched regions so that electroplating usually proves to be difficult with poor adhesion between the electroplated brazing alloy elemental constituents and the titanium substrate.

It is an object of the present invention to provide a method of treating titanium or a titanium base alloy surface in order to improve the adherence of a metal subsequently applied thereto by electroplating.

DESCRIPTION OF THE INVENTION

According to the present invention, a method of treating a titanium or titanium base alloy surface prior to the electroplating of a metal thereon comprises exposing said surfaces to an aqueous solution comprising hydrofluoric acid and formamide or a substituted formamide until reaction between said surface and said solution has substantially abated.

The titanium or titanium base alloy surface is preferably exposed to the solution by immersion. Vigorous gas evolution occurs and continues until a grey deposit begins to form on the titanium or titanium alloy surface. As the grey deposit builds up so the gaseous evolution decreases until eventually the gaseous evolution ceases.

After removal from the solution, the titanium or titanium alloy is then ready for electroplating by conventional means.

The exact nature of the grey deposit formed on the titanium or titanium base alloy substrate is not known. However, the deposit provides a key between the titaniun or titanium base alloy surface and the metal electroplated thereon so that adhesion between them is improved.

The aqueous solution may also contain a water soluble bifluoride. We have found that the addition of a water soluble bifluoride, such as ammonium bifluoride, results in an improvement in the quality of the electroplated coating and its adhesion to the titanium or titanium base alloy surface.

The solution preferably contains from 0 to 10 grams per liter of the water soluble bifluoride.

We have found that the aqueous solutions in accordance with the method of the present invention are most effective when their constituents are present in the following ranges:

| | |
|---|---|
| Formamide or substituted formamide | 600–800 grams per liter |
| Fluoride ions | 34–45 grams per liter |
| Hydrogen ions | 1.5–2.5 grams per liter |

The preferred substituted formamide is dimethylformamide and when present, it is preferred that sufficient water is present in the solution to ensure that the dimethylformamide constitutes from 60 to 80% weight/volume of the solution.

EXAMPLE 1

An aqueous solution in accordance with the method of the present invention was made up and contained the following:

| | |
|---|---|
| Dimethylformamide | 850 mls |
| 30% W/V Hydrofluoric acid | 150 mls |
| This provided a solution containing | |
| Dimethylformamide | 800 grams per liter |
| Water | 150 grams per liter |
| Hydrogen Fluoride | 50 grams per liter |

A titanium test piece 1.02 mm thick and 50 mm square was degreased in the commercially available compound known as Orthosil F2 before being immersed in the above aqueous solution. The solution was maintained at room temperature and the test piece immersed for ten minutes. There was a vigorous evolution of gas which ceased after three minutes upon the formation of a grey deposit upon the test piece surface. After ten minutes had elapsed, the test piece was removed from the solution. Examination of the test piece revealed that 0.0005 mm of metal had been removed from each surface by the solution.

A layer of nickel 0.005 mm thick was then electroplated on to the test piece followed by a layer of copper, also 0.005 mm thick. Nickel and copper were selected because together they form a brazing alloy suitable for titanium and its alloys.

The nickel plating solution contained the following constituents:

| | |
|---|---|
| Nickel Sulphamate | 345–355 g/l |
| Nickel Chloride | 5–6 g/l |

-continued

| | |
|---|---|
| Boric Acid | 30–33 g/l |

The pH of the solution was 3.5 to 4.5 and its temperature was 40°–45° C. The current density was up to 15 A/sq dm.

The copper plating solution contained the following constituents.

| | |
|---|---|
| Copper Pyrophosphate (Tryhydrate) | 70–74 g/l |
| Copper Metal | 23.5–24.5 g/l |
| Potassium Pyrophosphate (Anhydrous) | 245–255 g/l |
| Ammonium Hydroxide | 4 ml/l |

The pH of the solution was 8.6–9.2 and its temperature was 50°–55° C. The current density was up to 8 A/sq dm.

After electroplating, the test piece was bent through 90° around a cylindrical former. Qualitative assessment of adhesion was made by visual inspection. It was found that adhesion of the electroplated layers of nickel and copper was good with no cracking or peeling.

EXAMPLE 2

A further aqueous solution in accordance with the method of the present invention was made up and contained the following:

| | |
|---|---|
| Dimethylformamide | 640 mls |
| Ammonium Bifluoride | 5 g |
| Hydrogen Fluoride | 37.5 g |
| Water | 360 ml |

A test piece similar to that used previously but made of a titanium alloy containing by weight 6% aluminium and 4% Vanadium was first degreased in Orthosil F2 and then immersed in the solution. The solution was maintained at room temperature and the test piece immersed for ten minutes. As with the previous example there was rigorous gas evolution followed by the formation of the grey deposit. The test piece was then removed from the solution and examination revealed that 0.0025 mm of metal had been removed from each surface.

A layer of nickel 0.0025 mm thick and a layer of copper also 0.0025 mm were then electroplated on to the test piece in same manner as described previously.

Bend tests did not result in any cracking or peeling of the electroplated layers of nickel and copper.

It will be appreciated that whilst the method of the present invention has been described with reference to the electroplating of nickel and copper on to titanium and titanium base alloys, other metals could be electroplated if it is so desired.

Moreover, whilst the method of the present invention has been described with reference to a solution containing dimethylformamide, it is to be understood that formamide or another water soluble substituted formamide could be used in its place.

I claim:

1. A method of electroplating a metal layer onto a titanium or titanium base alloy surface, said method comprising the successive steps of:

(a) exposing the surface to be electroplated to an aqueous solution comprising hydrofluoric acid and a member selected from the group consisting of formamide and substituted formamides, said solution containing from about 35 to about 45 grams per liter of fluoride ions and from about 1.5 to about 2.5 grams per liter of hydrogen ions and from about 600 to 800 grams per liter of said formamide or said substituted formamide, and continuing the exposure until the reaction between said surface and said solution has substantially abated and a grey deposit, which provides an adhesion-improving key between the titanium or titanium base alloy surface and the metal to be electroplated thereon, is formed on the titanium or titanium alloy surface; and thereafter (b) electroplating a metal layer on the thus exposed surface covered by sid grey deposit.

2. A method of electroplating a metal layer onto a titanium or titanium base alloy, said method comprising the successive steps of:

(a) exposing the surface to be electroplated to an aqueous solution comprising hydrofluoric acid and a member selected from the group consisting of formamide and substituted formamides, said solution containing from about 35 to 45 grams per liter of fluoride ions and from 1.5 to 2.5 grams per liter of hydrogen ions and from about 600 to about 800 grams per liter of said formamide or said substituted formamide until the reaction between said surface and said solution has substantially abated and a grey deposit, which provides an adhesion-improving key between the titanium or titanium base alloy surface and the metal to be electroplated thereon, is formed on the titanium or titanium alloy surface, (b) electroplating a nickel layer on the thus-exposed surface covered by said grey deposit, and thereafter (c) electroplating a copper layer on the thus-deposited nickel layer.

3. The method of electroplating a titanium or titanium base alloy surface as claimed in claim 1 or 2 in which the aqueous solution additionally contains a water soluble bifluoride.

4. The method of electroplating a titanium or titanium base alloy surface as claimed in claim 3 in which the water soluble bifluoride is ammonium bifluoride.

5. The method of electroplating in which the titanium or titanium base alloy surface as claimed in claim 4 wherein said aqueous solution contains up to 10 grams per liter of ammonium bifluoride.

6. The method of electroplating a titanium or titanium base alloy surface as claimed in claim 1 or 2 in which the substituted formamide is dimethylformamide.

7. A method of electroplating a metal layer onto a titanium or titanium base, alloy surface, the method comprising the steps of:

(a) exposing the titanium or titanium base alloy surface to an aqueous solution comprising hydrofluoric acid and a member selected from the group consisting of formamide and substituted formamides, said solution containing from about 35 to 45 grams per liter of fluoride ions and from 1.5 to 2.5 grams per liter of hydrogen ions, and from about 600 to about 800 grams per liter of said formamide or said substituted formamide and additionally containing up to 10 grams per liter of a water soluble bifluoride, and continuing the exposure until the reaction between the surface and the solution has substantially abated and a grey deposit, which provides an adhesion-improving key between the titanium or titanium base alloy surface and the metal to be electroplated thereon, is formed on the titanium or titanium alloy surface; and thereafter (b) electroplating a metal layer onto the thus exposed surface covered by said grey deposit thereby improving the adhesion between the titanium or titanium alloy surface and the metal electro-deposited thereon.

* * * * *